US009228812B1

(12) United States Patent
White

(10) Patent No.: US 9,228,812 B1
(45) Date of Patent: Jan. 5, 2016

(54) BOWFISHING ARROW SLIDE ARRANGEMENT

(71) Applicant: Bear Archery, Inc., Evansville, IN (US)

(72) Inventor: David White, Logan, UT (US)

(73) Assignee: Bear Archery, Inc., Evansville, IN (US)

( * ) Notice: Subject to any disclaimer, the term of this patent is extended or adjusted under 35 U.S.C. 154(b) by 148 days.

(21) Appl. No.: 14/155,717

(22) Filed: Jan. 15, 2014

Related U.S. Application Data

(60) Provisional application No. 61/752,700, filed on Jan. 15, 2013.

(51) Int. Cl.
*F42B 6/04* (2006.01)
*F42B 12/68* (2006.01)
*F41B 5/14* (2006.01)

(52) U.S. Cl.
CPC ..... *F42B 6/04* (2013.01); *F41B 5/1488* (2013.01); *F42B 12/68* (2013.01); *F41B 5/143* (2013.01); *F41B 5/1484* (2013.01)

(58) Field of Classification Search
CPC ..... F41B 5/1484; F41B 5/1488; F41B 5/143
See application file for complete search history.

(56) References Cited

U.S. PATENT DOCUMENTS

| | | | | |
|---|---|---|---|---|
| 3,227,454 | A | 1/1966 | Ellenburg | |
| 3,614,947 | A | 10/1971 | Feldman | |
| 3,945,642 | A | 3/1976 | Henthorn, Jr. | |
| 4,846,481 | A | 7/1989 | Wageman | |
| 4,895,128 | A | 1/1990 | Okada | |
| 4,905,397 | A | 3/1990 | Juelg, Jr. | |
| 5,335,439 | A | 8/1994 | Horton | |
| 5,496,041 | A | 3/1996 | Broussard | |
| 5,553,413 | A * | 9/1996 | Gannon | 43/6 |
| 5,846,147 | A * | 12/1998 | Basik | 473/586 |
| 6,478,699 | B1 * | 11/2002 | Fairweather | 473/430 |
| 6,517,453 | B2 | 2/2003 | LaSee | |
| 2002/0198072 | A1 * | 12/2002 | LaSee | 473/578 |
| 2003/0045381 | A1 * | 3/2003 | Morris et al. | 473/578 |
| 2010/0229845 | A1 | 9/2010 | Woods, Jr. | |

* cited by examiner

*Primary Examiner* — John E Simms, Jr.

(74) *Attorney, Agent, or Firm* — Woodard, Emhardt, Moriarty, McNett & Henry LLP

(57) ABSTRACT

Embodiments of the present disclosure include a bowfishing slide arrangement for use with an archery bow. In certain embodiments, the arrangement includes a slide member having a sliding portion configured to slide along an arrow shaft and a flexible strand to which fishing line is configured to be attached. The flexible strand is engaged with and extends from the sliding portion. The arrangement further includes a stop used in cooperation with the slide member. The stop is arrangeable on the arrow shaft in a manner to prevent the slide member from sliding off of the arrow shaft. Additionally, the flexible strand creates a loop configured to extend beyond the end of the arrow shaft when the sliding portion contacts the stop.

17 Claims, 6 Drawing Sheets

BOWFISHING ARROW SLIDE ARRANGEMENT

CROSS-REFERENCE TO RELATED APPLICATION

This application claims the benefit of U.S. Provisional Patent Application No. 61/752,700, filed Jan. 15, 2013, which is hereby incorporated by reference in its entirety.

FIELD OF THE INVENTION

The present invention relates to archery bows and more particularly pertains to a slide arrangement for use with a bow and arrow.

BACKGROUND OF THE INVENTION

In bowfishing, a fishing line is attached to the arrow that is projected at a target, allowing the arrow and any connected targets to be retrieved after firing. In certain arrangements, the line is attached to the arrow by an arrow slide arrangement that helps prevent the line from interfering with or becoming tangled with parts of the bow while the arrow is being drawn and released.

SUMMARY OF THE INVENTION

Bowfishing arrangements according to certain embodiments described herein include bowfishing slide apparatuses configured for use with archery bows. In typically embodiments, an archery bow includes a bow body with a riser and upper and lower limbs. A bowstring extends between the upper and lower limbs. An arrow is equipped with a stop near the rear of the arrow shaft and a slide assembly. The slide assembly includes a sliding portion configured to slide along an arrow shaft and a flexible strand to which fishing line is configured to be attached. In the illustrated embodiments, the flexible strand is engaged with and extends from the sliding portion. The stop may be arrangeable on the arrow shaft in a manner to prevent the slide member from sliding off of the arrow shaft.

In certain specific embodiments, the sliding portion defines two or more attachment points and an interior passage. The passage allows the sliding portion to translate along portions of the arrow shaft. The flexible strand has two or more attaching segments, each engaging an attachment point of the sliding portion, and defines a loop. The loop is sized to extend behind the arrow when the sliding portion is adjacent to the stop. In such embodiments, a fishing line is secured to the loop. The fishing line may be secured to the bow, for example to a reel secured to the bow body.

Other objects and attendant advantages will be readily appreciated as the same become better understood by references to the following detailed description when considered in connection with the accompanying drawings.

DESCRIPTION OF THE ILLUSTRATED EMBODIMENTS

For the purposes of promoting an understanding of the principles of the disclosure, reference will now be made to the embodiments illustrated and specific language will be used to describe the same. It will nevertheless be understood that no limitation of the scope of the disclosure is thereby intended, such alterations, modifications, and further applications of the principles being contemplated as would normally occur to one skilled in the art to which the invention relates.

Embodiments disclosed herein include a bowfishing arrow slide arrangement for use with an archery bow. In certain configurations, a slide is arranged on an arrow shaft and a flexible member is connected to both the slide and a fishing line. When a bow and arrow are in a drawn position, the slide is located at or near the front of the arrow. As the arrow is fired, the arrow slides through the slide until the slide contacts a stop located near the rear of the arrow, after which the flexible member trails the arrow and pulls the fishing line in a direction substantially along the path of the arrow.

Figure 1:
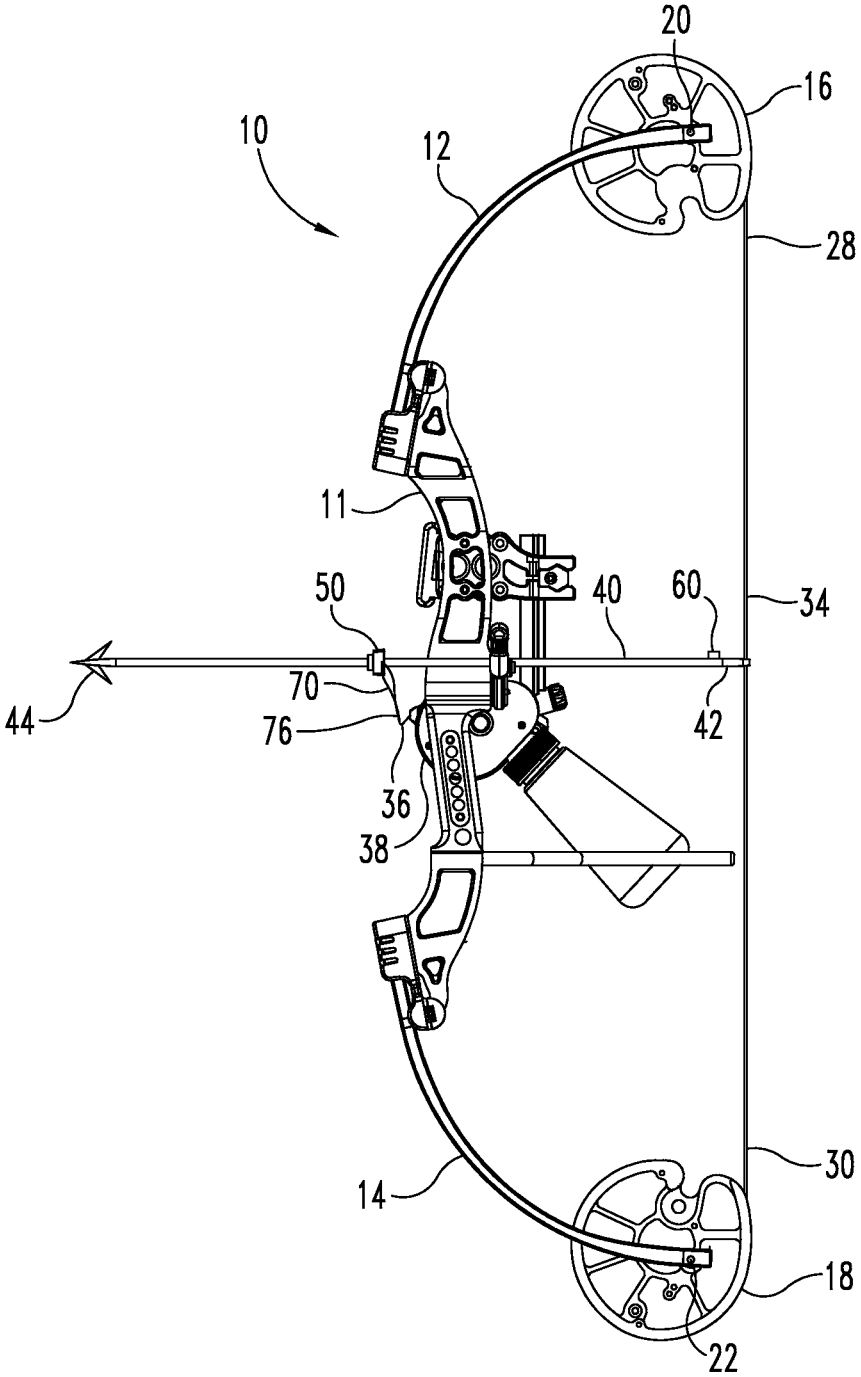
FIG. 1 is a side view of an archery bow in an undrawn position incorporating a bowfishing arrow slide arrangement according to a preferred embodiment of the present disclosure.

FIG. 1 illustrates an example of a conventional dual cam compound bow generally designated 10. When viewed from the perspective of an archer holding the bow, it includes a riser 11 with a handle, an upper limb portion 12, and a lower limb portion 14 forming a bow body. In the dual cam bow example illustrated, rotational members such as cams 16 and 18 are supported at the limb tip sections for rotary movement about axles 20 and 22. In the embodiment shown, upper and lower limbs are formed of parallel and symmetric limb portions sometimes called quad limbs. Alternately, a single piece limb can have a notch or slot area removed to allow a rotational element to be mounted to the limb tip. An upper pulley axle 20 is carried between the outer limb tip portions of upper limb 12. A lower pulley axle 22 is carried between the outer limb tip portions of lower limb 14.

The portion of the cable which defines the bowstring cable 34 includes an upper portion 28 and a lower end portion 30 which are fed out from cams 16 and 18 when the bow is drawn. The non-bowstring portions of the cable arrangement including return or cross cables extending between the cams and/or limb tips are not illustrated for ease of reference. Each cable has a thickness and one or more strands forming a round cross-section defining a circumference.

From the perspective of the archer, the bowstring is considered rearward relative to the riser which defines forward. Directional references herein are for ease of explanation and are not intended to be limiting. Similarly, a bow riser held with the left hand is illustrated, but is not intended to be limiting. A symmetric arrangement can be used with a bow having a right-handed riser.

When the bowstring 34 is drawn, it causes cams 16 and 18 at each end of the bow to rotate, feeding out cable and bending limb portions 12 and 14 inward, causing energy to be stored therein. When the bowstring 34 is released with an arrow engaged to the bowstring, the limb portions 12 and 14 return to their rest position, causing cams 16 and 18 to rotate in the opposite direction, to take up the bowstring 34 and launch the arrow with an amount of energy proportional to the energy initially stored in the limbs. Bow 10 is described for illustration and context and is not intended to be limiting.

Certain embodiments can also be used with single or hybrid cam compound bows. A single cam bow includes a similar riser with a handle, upper limb portions, and lower limb portions. Rotational members such as an upper idler wheel and a lower eccentric cam are supported at the limb tip sections for rotary movement about their axles. A bowstring cable includes an upper end fed-out from the upper wheel and a lower end mounted to an fed-out from the lower cam when the bow is drawn. A return cable portion has an upper end wrapped around the upper cam and a lower end mounted to the lower cam, with the lower end fed-out from the cam as the bow is drawn. Additionally, a y-yoke anchor cable has a lower end mounted to the lower cam and two upper ends mounted to the axle of the upper cam. The lower end is taken in to the lower cam as the bow is drawn. References herein to a bowstring or cable portion extending to the limb tips are intended to broadly include a cable portion wrapped around or mounted to a track of a rotational element or an attachment to an axle mounted at the limb tips.

The present disclosure can also be used in other types of bows, for example recurve bows, hybrid cam bows, or crossbows, all of which are considered conventional for purposes of the present disclosure. For convenience, the combination of riser 11 and either single or quad limbs forming upper limb 12 and lower limb 14 may generally be referred to as a bow body. It should be appreciated that a bow body can take on various designs in accordance with the many different types of bows. Similarly, a bowfishing arrangement can take on a variety of designs by adding a line or reel to any of the various bow body types.

In some variations, an arrow is included in the bowfishing arrangement and includes a shaft 40, a nock 42, and a point 44. The point is at the forward end of the shaft and the nock is at the rear and is adapted to engage with a bowstring. The arrow also includes a slide 50 and stop 60. The stop 60 is located along the rearward portion of shaft 40 near or part of nock 42. The slide 50 includes a slide body or a sliding portion 51 with an interior surface defining an interior passage 52 allowing the sliding portion 51 to slide along the arrow shaft 40. In certain embodiments, the interior passage 52 is generally cylindrical with an inner diameter that is approximately equal to the outer diameter of the shaft 40. The interior passage may be shaped differently in other embodiments. Stop 60 prevents slide from sliding off the rear of the shaft 40.

Figure 2:
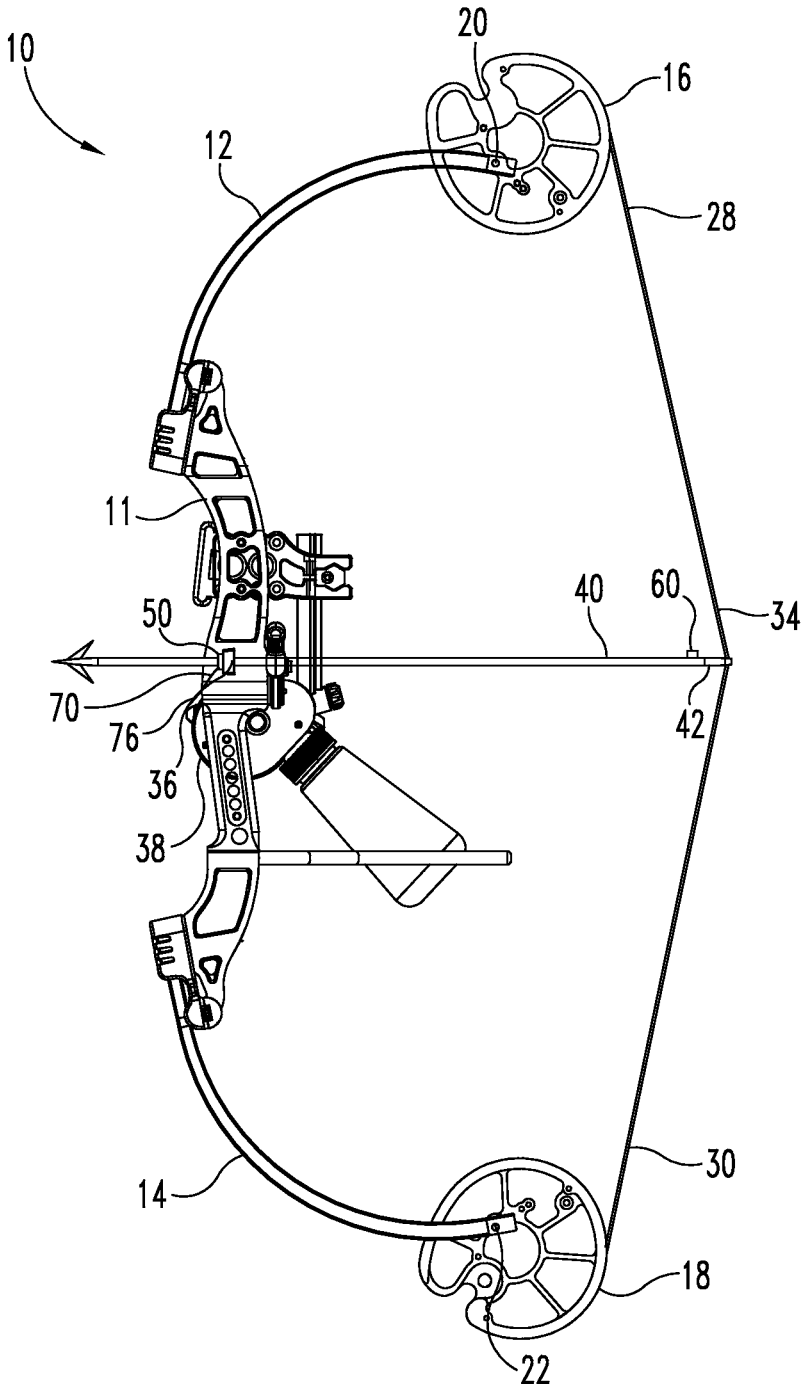
FIG. 2 is a view of the bow of FIG. 1 in a drawn position.

The slide 50 further includes a flexible strand or flexible member 70 engaged with and extending from the sliding portion 51. In the particular illustrated embodiments, the sliding portion 51 may have two or more attachment points 56, 58 where the flexible member 70 engages with the sliding portion 51 (see FIGS. 3-4). In such embodiments, flexible member 70 has two or more attaching segments 72, 74 engaging the sliding portion 51 at attachment points 56, 58. Attaching segments 72, 74 may or may not correspond with the end portions of the flexible member 70. The flexible member 70 defines a loop 76 that is sized and configured to extend behind the rear of the arrow shaft when the slide 50 abuts the stop 60, as seen, for example, in FIGS. 3, 4, and 6. The loop 76 is also suitable to be secured to one end of a fishing line 36. The other end of the fishing line 36 may be secured to a bow 10, for example by connecting to a reel 38 mounted to bow body 10, as seen in FIGS. 1-2. Although reel 38 is illustrated below the arrow shaft 40, in other arrangements the reel 38 may be mounted above the plane where the arrow shaft 40 is drawn and released.

Preferably, the loop 76 may be long enough to extend behind the rear of the arrow when the slide 50 is arranged on an arrow shaft and the slide 50 abuts the stop 60. For example, the loop 76 may define a length or a distance which it extends from the sliding portion 51 along a straight line axis. The distance the loop extends from the sliding portion 51 may be more than twice the distance from the rear of the sliding portion 51 to the rearward end of the arrow shaft when the sliding portion 51 abuts the stop 60. In optional embodiments, including the illustrated embodiment, a portion of the flexible member 70 may be gathered or pulled together by clasp 77 to form a secondary loop 78. The secondary loop 78 can be sized and arranged so that an attached fishing line 36 can be secured at or near the central point 79 of the secondary loop 78. If the secondary loop 78 is absent, the fishing line 36 may be secured to the loop 76. The flexible member 70 may be formed from a variety of materials, including but not limited to wire, string, or synthetic filaments. The member 70 may be a single strand of material or multiple strands. When multiple strands are used, the strands may optionally be twisted or braided to increase strength of the member and avoid tangling of strands.

Figure 3:
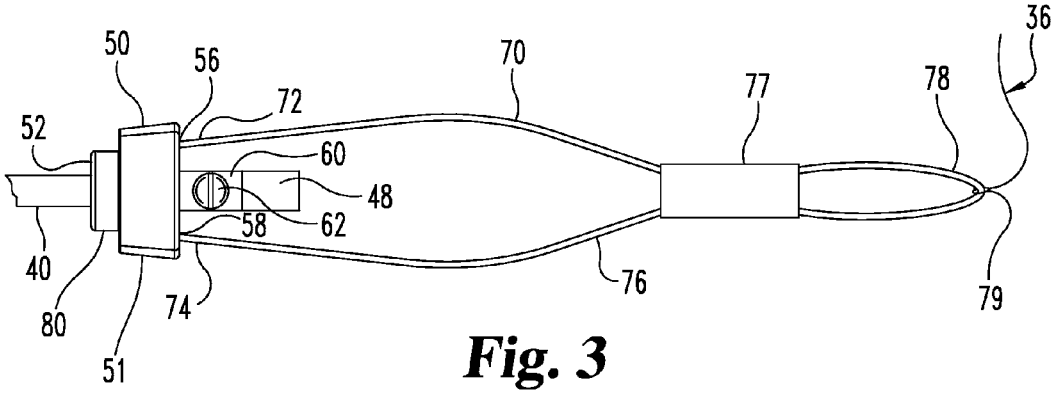
FIG. 3 is a top view of a bowfishing arrow slide arrangement of the present disclosure.

In arrangements where loop 76 is sized to extend behind the rear of the arrow shaft 40 when the sliding portion 51 is adjacent to the stop 60 such as, for example in FIG. 3, the arrow may, during flight, pull the fishing line 36 attached to the flexible member 70 directly behind and aligned with the axis of the arrow shaft 40. When the flexible member 70 is configured with a secondary loop 78, attaching the fishing line 36 at or near central point 79 of the secondary loop 78 further assists in pulling the fishing line 36 along the axis of the arrow. In this way, the amount of drag on the arrow may be reduced. Preferably, the arrow can fly straighter and accuracy is improved.

Figure 4:
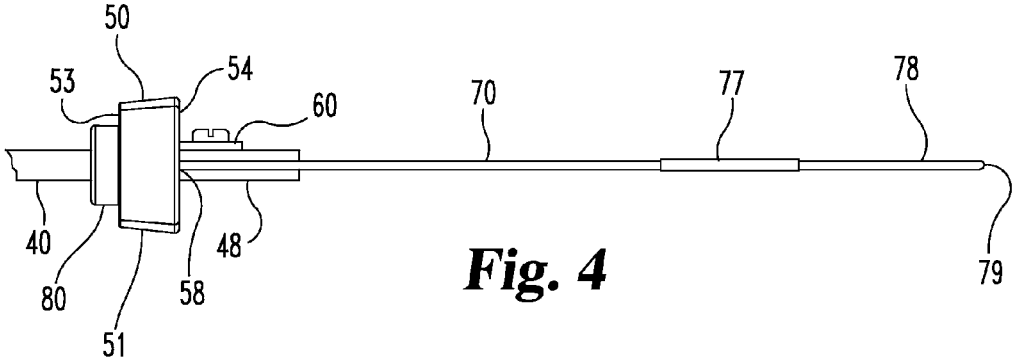
FIG. 4 is a side view of a bowfishing arrow slide arrangement in place on an arrow shaft.
Figure 5:
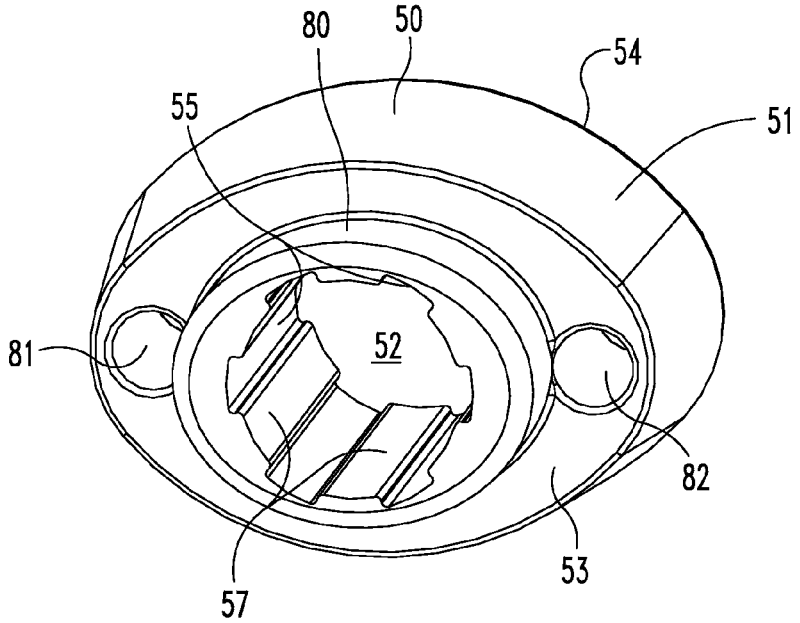
FIG. 5 is a perspective view an arrow slide suitable for use in a bowfishing arrow slide arrangement of the present disclosure.

In certain arrangements, some or all of the exterior of the sliding portion 51 approximates the shape of a truncated cone, truncated pyramid, or other form of frustum. The truncated form may have a variety of different base shapes. As examples, the form may be circular, elliptic, or polygonal in cross-section. In one specific example, all or a substantial portion of the sliding portion 51 may be frusto-conical in shape. In FIGS. 4-5, the narrow end 53 of the slide is closer to the forward end of the arrow shaft 40 and the wider end 54 is closer to the rearward end of the arrow shaft 40. The central axis of the slide passage 52 preferably coincides with the longitudinal axis of the arrow shaft 40. In some configurations, a conical shape improves aerodynamics of the slide and permits truer flight of the arrow.

The sliding portion 51 may, in some variations, be rotatable around the arrow shaft 40. For example, the sliding portion 51 may have a substantially cylindrical interior passage 52 that allows the sliding portion 51 to rotate around an arrow shaft with a circular cross-section. In other forms, as shown in FIG. 5, the interior surface defining the interior passage 52 may include one or more recessed portions 55 and/or one or more raised portions 57, optionally in an alternating fashion. In some configurations, interior passage 52 may be characterized by a first radius $r_1$ defined by the distance from the central axis of the passage to the raised portions 57 and a second radius $r_2$ defined by the distance from the central axis of the passage to the recessed portions 55. Preferably, $r_2$ is greater than $r_1$ and $r_1$ is approximately equal to the radius of the arrow shaft 40. When the sliding portion 51 is installed on an arrow, raised portions 57 are closer to the shaft of the arrow and may assist in smoother translation of the sliding portion 51 along the shaft. Recessed portions 55 may prevent passage 52 from fouling and help to allow the sliding portion 51 to function after the sliding portion 51 is exposed to sand, mud, or other substances. Alternately, as other options, the interior passage may be hexagon-shaped or otherwise polygon-shaped, defining recessed corner areas. In such configurations, the corner areas help to prevent the passage from fouling, as discussed above.

Preferably there is minimal translational friction between the sliding portion 51 and the arrow shaft 40. In some forms, at least the portions of the sliding portion 51 in contact with an arrow shaft may be formed from self-lubricating materials, such as Delrin® plastic to give one non-limiting example. Alternatively, the interior passage of the sliding portion 51 may be lubricated or it may be coated with low friction materials, such as Teflon® coating, to reduce friction. In some forms, the arrangement of alternating recessed portions 55 and raised portions 57, as seen in FIG. 5, may reduce the surface area of the interior passage 52 in contact with the arrow shaft 40 and reduce friction between the sliding portion 51 and the shaft 40. According to other arrangements, the slide 50 may include wheels, bearings, or other rotational elements in contact with an arrow shaft that reduce friction between the shaft and the slide.

Figure 6:
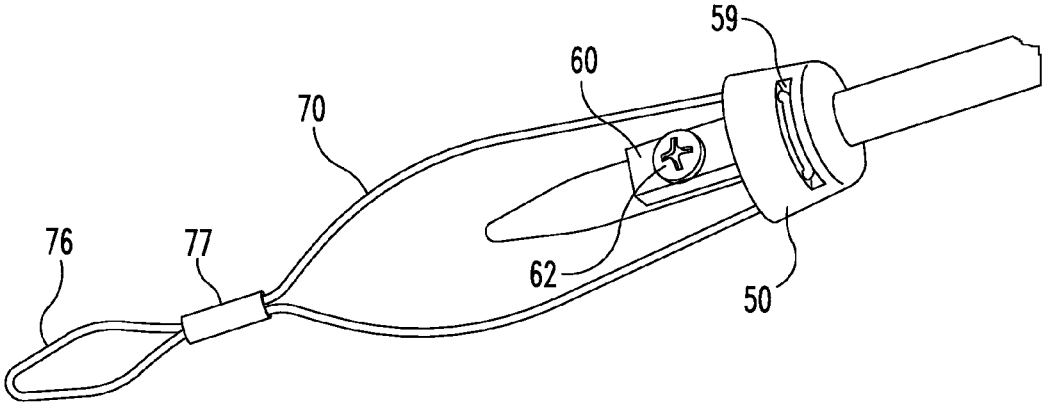
FIG. 6 is a perspective view of another embodiment of a bowfishing arrow slide arrangement in place on an arrow shaft.

According to other alternative variations, as shown with reference to FIG. 6, the sliding portion 51 may include a groove or indentation 59 around approximately one-half of the circumference of sliding portion 51. Two holes may extend from the rear of the sliding portion 51 to the groove 59, and flexible member 70 may be threaded through one hole, around the groove 59, and out the other hole out of the back of sliding portion 51. In this alternative arrangement, attaching segments 72, 74 may not correspond with the ends of the flexible member 70. Rather, attaching segments 72, 74 may be defined by segments of the flexible member 70 which are threaded through the holes and around the groove 59.

Preferably, attachment points 56, 58 may be located on diametrically-opposed sides of the sliding portion 51. In certain embodiments, the sliding portion 51 may be formed so that attachment points 56, 58 are on the rearward end of the sliding portion 51 closest to the nock, as in FIGS. 3-4. Segments or ends of the flexible member 70 may be attached at the attachment points 56, 58 by a variety of possible treatments, including for example as adhesives, embedding the ends in the slide body by casting or forming the slide around portions of the flexible member, or mechanical fasteners including, for example, screws, pins, or cams.

Figure 7B:
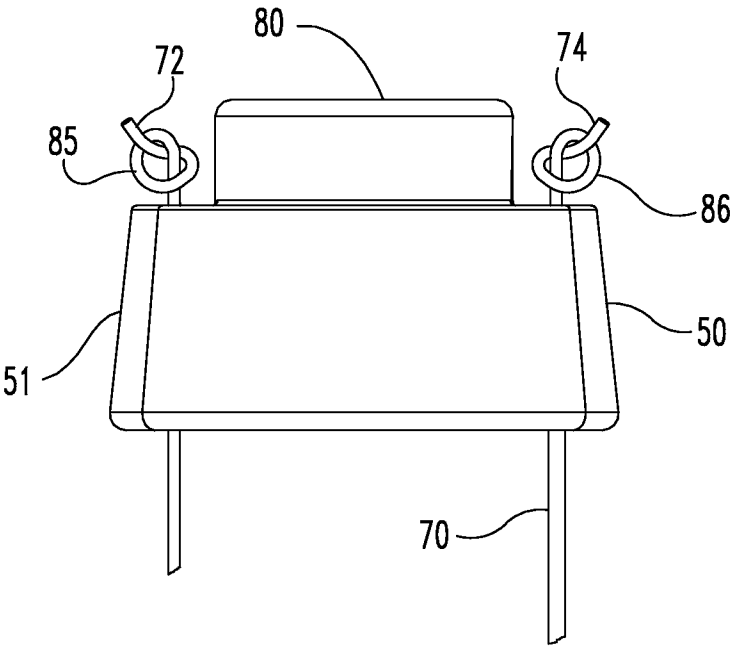
FIGS. 7A and 7B are side views of portions of embodiments of the slide arrangement of the present disclosure.
Figure 7A:
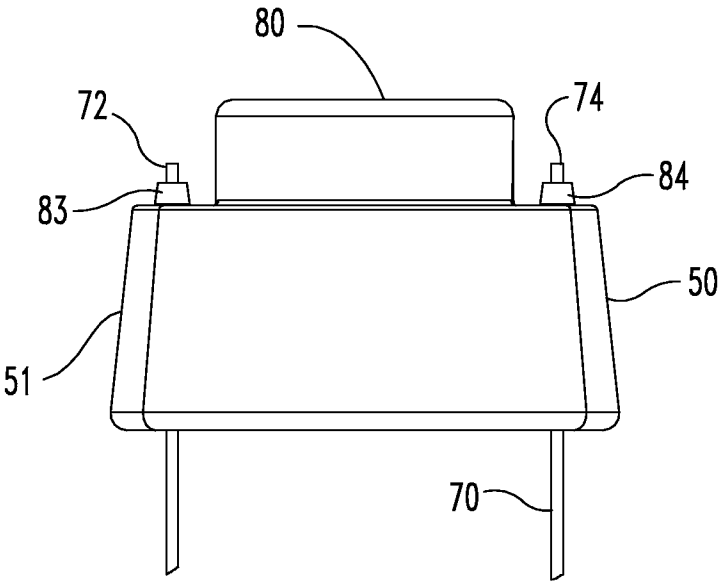

In other embodiments, as depicted in FIG. 5, attachment points 56, 58 may be in the form of holes 81, 82 extending through the sliding portion 51. In this arrangement, attaching segments 72, 74 can be threaded through the attachment point holes 81, 82, and secured forward end of the sliding portion 51. Such embodiments may provide for easy repair or replacement of the flexible member 70, if necessary. After being threaded through holes 81, 82, attaching segments 72, 74 may be knotted, capped, fitted with compression sleeves, or otherwise secured to prevent detachment of the flexible member 70 from the sliding portion 51. For example, as illustrated in FIG. 7A, the ends of attaching segments 72 and 74 are secured with compression sleeves, caps, or other mechanical fasteners 83 and 84. As another example, in FIG. 7B, attaching segments 72, 74 form knots 85 and 86 to prevent flexible member 70 from detaching from the sliding portion 51. In certain optional embodiments, the sliding portion 51 may include an extension flange 80 extending from the forward end of the sliding portion 51. The optional flange 80 may be configured to extend beneath the ends of the flexible member 70 to prevent the ends of the flexible member 70 from contacting the arrow shaft 40.

Figure 8:
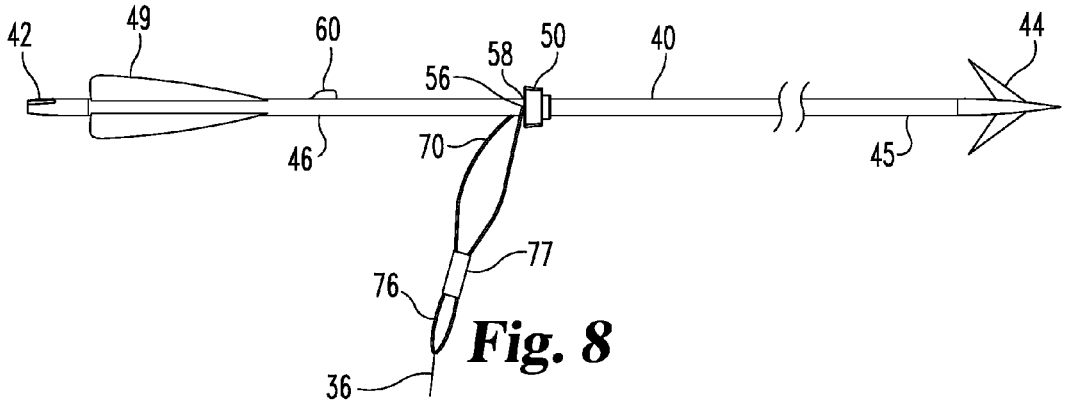
FIG. 8 is a side view of an arrow including a bowfishing arrow slide arrangement according to another embodiment of the present disclosure.
Figure 9:
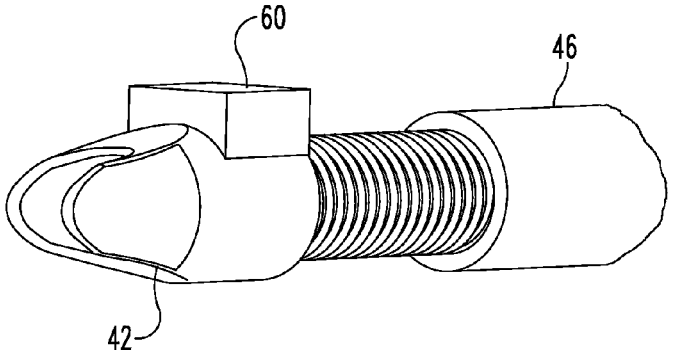
FIG. 9 is perspective view of a portion of an arrow.

FIG. 8 illustrates one particular example embodiment of an arrow arrangement. The arrow includes elongate shaft 40 having a forward end 45 and rearward end 46 with a nock 42 at the rearward end. Shaft 40 may be formed from a variety of materials, including but not limited to wood, aluminum, carbon fiber, composites, or combinations thereof. Attachment of an optional arrowhead or point 44 to forward end 45 can be accomplished in a variety of ways known to those of skill in the art, including with a threaded shaft, adhesives, caps, tangs, or hafting, and all are contemplated in the disclosure. As illustrated, the stop 60 is located at or near the rear of shaft 40, rearward of the slide 50. In some arrangements, such as in FIG. 6, stop 60 may be a separate piece that is attached to arrow shaft 40, such as by a mechanical device such as screw 62. Optionally, fletching 49 may be included between the nock 42 and the stop 60. Alternatively, as shown in FIG. 8, arrow shaft 40 may be constructed to include stop 60. In some possible variations, the stop 60 is incorporated into the nock 42, as shown in FIG. 9. In certain embodiments, the stop 60 may be composed of a substantially rigid material. However, it should be appreciated that the stop 60 may be formed and/or configured differently. The slide 50 is positioned along the shaft 40 between the stop 60 and the forward end 45. As discussed above, the flexible member 70 extending from the sliding portion 51 includes loop 76 which is preferably sized to extend behind the arrow shaft 40 when the sliding portion 51 abuts the stop 60.

In use, a bowfishing archery bow may be used to shoot an arrow. With a bow, an arrow, a stop near the rear of the arrow, a sliding portion on the shaft of the arrow, and a flexible member attached to the sliding portion and secured to one end of a fishing line with the other end secured to the bow body, the nock of the arrow is placed adjacent to the bowstring in an undrawn position. As the bowstring and arrow are pulled rearward, drag on the slide allows the shaft to pass through the sliding portion and the sliding portion, the flexible member, and the fishing line may remain substantially in front of the riser or aligned adjacent with the riser body. Once the bow is drawn, the bent limbs of the bow body store energy. When the bowstring is released, the limbs return to their original position and kinetic energy is transferred to the arrow. As the arrow is projected forward, it moves faster than and through the sliding portion, relatively translating the slide towards the rear of the arrow. When the sliding portion reaches the stop, a portion of the flexible member is pulled to a position trailing the arrow, and the fishing line is pulled by the arrow substantially along the trajectory of the arrow. Optionally yet preferably, the fishing line can be used to retrieve the arrow and any items attached thereto.

While the invention has been illustrated and described in detail in the drawings and foregoing description, the same is to be considered as illustrative and not restrictive in character, it being understood that only the preferred embodiments have been shown and described and that all changes and modifications that come with the spirit of the invention are desired to be protected.

What is claimed is:

1. A bowfishing apparatus for use with an archery bow, the apparatus comprising:

a slide having a sliding portion configured to slide along an arrow shaft and a flexible strand to which fishing line is configured to be attached, wherein the flexible strand is engaged with and extends from the sliding portion;

a stop arrangeable on the arrow shaft in a manner to prevent the slide from sliding off of the arrow shaft;

wherein the flexible strand creates a loop configured to extend beyond the end of the arrow shaft when the sliding portion contacts the stop; and, a clasp engaged with the flexible strand to create a secondary loop to which the fishing line is attached.

2. The bowfishing apparatus of claim 1, wherein the sliding portion includes an interior surface defining an interior passage configured to receive the arrow shaft, and wherein the interior surface defines at least one recessed section.

3. The bowfishing apparatus of claim 1, wherein the sliding portion includes an interior surface defining an interior passage configured to receive the arrow shaft, and wherein the interior surface defines alternating recessed and raised sections.

4. The bowfishing apparatus of claim 1, wherein the sliding portion includes an interior surface and wherein at least the interior surface is formed from a self-lubricating material.

5. The bowfishing apparatus of claim 1, wherein the sliding portion includes an exterior surface having a substantially frusto-conical shape.

6. The bowfishing apparatus of claim 1, wherein the stop is made of a substantially rigid material.

7. The bowfishing apparatus of claim 1, wherein the sliding portion defines two holes and the flexible strand includes two strand ends inserted through the holes to engage the flexible strand with the sliding portion, wherein the ends of the flexible strand are secured to prevent disengagement of the flexible strand from the sliding portion.

8. The bowfishing apparatus of claim 7, wherein the ends of the flexible strand are knotted.

9. The bowfishing apparatus of claim 7, wherein each of the ends of the flexible strand is secured with a mechanical fastener.

10. The bowfishing apparatus of claim 7, wherein the sliding portion includes an extension flange configured to extend beneath the ends of the flexible strand to prevent the ends of the flexible strand from contacting the arrow shaft.

11. An archery bow used for fishing, comprising:

an archery bow body defining opposing tips;

a bowstring extending between the opposing tips;

an arrow configured to be shot from the archery bow body, wherein the arrow includes a shaft extending between a forward end and a rearward end;

a slide having a sliding portion engaged with and surrounding the arrow shaft, wherein the slide further includes a flexible strand engaged with and extending from the sliding portion;

a stop arranged on the arrow shaft between the slide and the rearward end of the shaft, wherein the stop is configured to prevent the slide from sliding off of the arrow shaft;

a fishing line secured to the flexible strand;

wherein the sliding portion is configured to slide along the arrow shaft, and wherein the flexible strand creates a loop configured to extend beyond the rearward end of the arrow shaft when the sliding portion abuts the stop; and, a clasp engaged with the flexible strand to create a secondary loop to which the fishing line is attached.

12. The bowfishing apparatus of claim 11, wherein the distance by which the loop configured to extend beyond the rearward end of the arrow shaft extends, is at least two times greater than the distance between the sliding portion and the rearward end of the shaft when the sliding portion abuts the stop.

13. The bowfishing apparatus of claim 11, wherein the flexible strand includes two ends engaging the flexible strand with the sliding portion, wherein the flexible strand has a central point substantially equidistant between the two ends, and wherein the fishing line is secured to the flexible strand at or near the central point.

14. The bowfishing apparatus of claim 11, wherein the sliding portion includes an interior surface defining an interior passage configured to receive the arrow shaft, and wherein the interior surface defines alternating recessed and raised sections.

15. The bowfishing apparatus of claim 11, wherein the sliding portion includes an exterior surface having a substantially frusto-conical shape.

16. The bowfishing apparatus of claim 11, wherein the stop is made of a substantially rigid material.

17. The bowfishing apparatus of claim 11, wherein the sliding portion defines two holes and the flexible strand includes two strand ends inserted through the holes to engage the flexible strand with the sliding portion, wherein the ends of the flexible strand are secured to prevent the flexible strand ends from backing out of the holes and thereby disengaging the flexible strand from the sliding portion.

* * * * *